United States Patent [19]

Diaz

[11] 4,180,173

[45] Dec. 25, 1979

[54] TAMPER-PROOF CLOSURE SYSTEM

[75] Inventor: Stephen H. Diaz, Los Altos Hills, Calif.

[73] Assignee: Raychem Corporation, Menlo Park, Calif.

[21] Appl. No.: 860,196

[22] Filed: Dec. 13, 1977

[51] Int. Cl.[2] ..... B65D 1/04

[52] U.S. Cl. ..... 215/6; 215/253; 215/256; 128/272.1; 128/272.3; 222/129; 222/153

[58] Field of Search ..... 215/6, 253, DIG. 8; 128/218 M, 218 S, 272, 272.1, 272.3, DIG. 28; 206/219, 222; 220/266, 267, 276; 222/129, 88, 83, 83.5, 153, 541

[56] References Cited

U.S. PATENT DOCUMENTS

| | | | |
|---|---|---|---|
| 3,198,194 | 8/1965 | Wilburn | 215/6 |
| 3,348,740 | 10/1967 | O'Donnell | 222/153 |
| 3,403,823 | 10/1968 | O'Donnell | 222/153 |
| 3,977,555 | 8/1976 | Larson | 128/272 |

FOREIGN PATENT DOCUMENTS

| | | | |
|---|---|---|---|
| 935117 | 8/1963 | United Kingdom | 220/266 |

*Primary Examiner*—R. E. Hart

*Attorney, Agent, or Firm*—Blanchard, Flynn, Thiel, Boutell & Tanis

[57] ABSTRACT

Described herein are sterile vessels, as for pharmaceutical use, wherein there is disposed about a primary closure partially protuberant from the vessel a secondary closure resistive of non-destructive disengagement. The secondary closure, which is preferably heat shrunk about the vessel neck and primary closure, is provided with an attenuated fracture zone to facilitate opening. The invention finds application, e.g. in multicompartment mixing vials wherein the primary closure serves as a piston plug which, when activated, unseats a divider plug separating compartments containing medicaments or the like which are accordingly permitted to mix.

5 Claims, 3 Drawing Figures

TAMPER-PROOF CLOSURE SYSTEM

BACKGROUND OF THE INVENTION

Plural compartment mixing vials like those described in Lockhart U.S. Pat. Nos. 2,695,614, Bujan 2,908,274 and Sponnoble 3,464,414 have found widespread application in packaging of medicaments and other substances which, by reason of their instability, must be mixed shortly before use. In such devices, a lower compartment may contain a pulverulent material while a liquid is contained in an upper compartment divided therefrom by a divider plug seated in a constriction in the vial. When a stopper or "piston plug" in the neck of the vial is despressed, hydraulic pressure is transmitted through the liquid to unseat the divider plug, whereupon mixing occurs. Heretofore, the piston plug has been retained in the neck of the bottle by a metal ferrule which is rolled or crimped about a bead formed on the neck after the contents of the vial have been added and the stopper inserted. While that means of plug retention has proved satisfactory in some respects, it suffers the disadvantage of permitting inadvertent depression of the piston plug with consequent premature mixing of the vial contents—i.e., it is not "tamper proof". Again, the rolling process by which the ferrule is crimped about the neck of the vial requires that the latter be formed to close tolerances to minimize breakage and consequent contamination of the vial contents during that operation. In spite of the attention heretofore paid to dimensioning the vial for satisfactory ferrule application, scrap arising from breakage during that operation has remained a problem.

SUMMARY OF THE INVENTION

According to this invention, there is provided a sterile closed vessel comprised of a housing whose dispensing end is stopped with a piston plug or like primary closure about a partially protuberant portion of which is disposed a hollow, frangible secondary closure. The lower portion of the closure is affixed to the neck of the vial while an upper portion thereof serves as a plunger. An attenuated fracture zone is disposed about the lowermost periphery of the plunger so that fracture occurs when thrust is imposed on the plunger, whereupon the plunger engages the primary closure and drives it inwardly along the longitudinal axis of the housing.

The secondary closure may be either heat shrunk or snap fit into engagement with the vessel neck, obviating the ferrule crimping operation hitherto practiced.

Tamper-proof closures have hitherto been provided by the use of heat recoverable materials. See e.g. Pike et al., U.S. Pat. Nos. 2,790,285, Fujio 3,623,624, old et al., 3,741,422 and British Pat. No. 1,088,552. Rigid closures have hitherto have been provided with fracture zones, as in the case of British Pat. No. 758,943, Hayes U.S. Pat. Nos. 3,073,471, Parker 3,081,899 and Kitterman 3,170,603. In contradistinction to these prior works, the present invention provides, e.g., a secondary closure which may be heat recoverable and so configured as to employ the very force required to break the secondary closure in driving a primary closure into the vessel, a property whose useful advantages will appear from the detailed description of the invention.

Accordingly, it is an object of the present invention to provide a tamper-proof secondary closure which protects the outer surface of the primary closure from contamination during both storage of the closed vessel and the activation of the primary closure.

Another object of the present invention is to employ a fragment of the secondary closure as a tool to activate the primary closure.

A further object of the present invention is the provision of a vessel closure structure, as aforesaid, requiring a minimum amount of force to displace the divider plug.

BRIEF DESCRIPTION OF THE DRAWINGS

Further objects and advantages of the present invention will appear from the detailed description and the accompanying drawings in which.

DETAILED DESCRIPTION OF THE INVENTION

Figure 1:
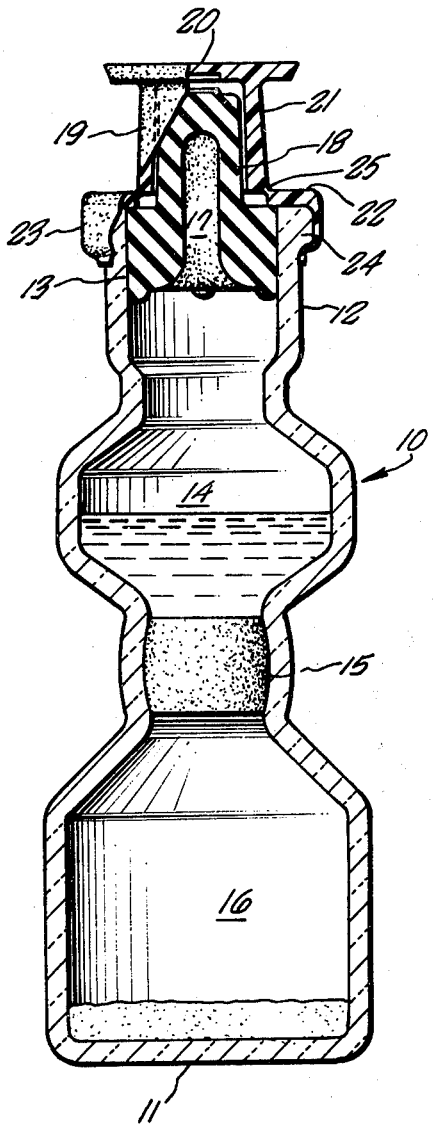
FIG. 1 is a partially sectioned elevation view of a multi-compartment vial about whose primary closure has been recovered a secondary closure.
Figure 2:
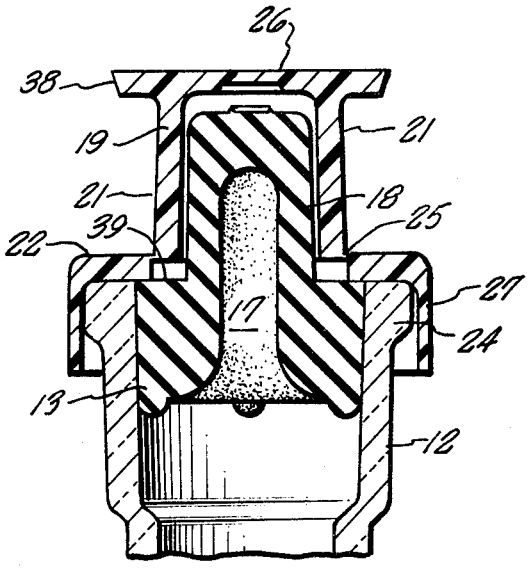
FIG. 2 is a partial, sectioned view which, inter alia, depicts the secondary closure of FIG. 1 prior to recovery thereof.

With reference first to FIGS. 1 and 2, a sterile, closed vessel generally indicated as 10 is comprised of an elongate housing having a closed end 11 and a neck 12 adjacent a dispensing end in which is snugly and slidably disposed a primary closure or stopper 13. Vessel 10, as illustrated, is a "multi-compartment mixing vial", i.e., a vessel whose plural compartments are separated by a divider plug which can be unseated by depressing the primary closure, permitting mixing of the contents of the respective compartments. Thus, in the device illustrated in FIG. 1, when stopper 13 is forced a sufficient distance toward closed end 11, hydraulic pressure transmitted through compartment 14 dislodges divider plug 15, whereupon the fluid contained in compartment 14 may be mixed with a pulverulent medicament or the like contained in compartment 16. As is conventional, stopper 13 is provided with an axial recess 17 so that the upper end of its protuberant portion 18 forms a diaphragm readily penetrated by a hypodermic syringe or the like, once mixing has been completed. Disposed about the protuberant portion of stopper 18 is a hollow, frangible secondary closure 19 comprising a plunger having top wall 20 and upstanding sidewalls 21. Secondary closure 19 is additionally comprised of mid-portion 22, which integrally joins the plunger defined by walls 20 and 21 to a lower collar, which latter is in encircling engagemnt with secondary closure anchorage means such as the bead 24 so as to resist nondestructive disengagement therefrom. Disposed about the lowermost periphery of the plunger sidewalls 21 is an attenuated fracture zone 25 which may be defined, e.g., by a circular or substantially circular groove, thinned annulus, or otherwise configured to create a stressed-raising characteristic intermediate mid-portion 22 and plunger 19.

With reference now to FIG. 2, in which like reference numerals depict like elements, secondary closure 26 is depicted prior to recovery of collar 27 about bead 24. Secondary closure 26 is preferably formed by the injection molding of a polymeric material. If so desired, the collar 27 can be configured to snap into engagement with the bead 24. Alternatively, the collar 24 can be made to recover about the bead 24 upon the application of heat.

Many methods are known for making polymeric materials heat recoverable. One such method is described by Cook et al., U.S. Pat. No. 3,086,262. For example, the secondary closure 26 can be made heat recoverable by: initially disposing the collar 27 inwardly; cross-linking the polymeric material with a dose of high energy ionizing radiation; heating the collar above its crystallization temperature; expanding the collar to the configuration shown in FIG. 2 and allowing the collar to cool in this expanded configuration. When so processed and raised to its crystallization temperature or other heat recovery temperature, the collar 27 will shrink to conformably engage the bead 24 (see FIG. 1). Preferably, essentially only the collar of the closure is heated during heat recovery, as by appropriate shielding, use of a pencil heater, etc. Thus, any injection-moldable polymeric material (e.g., polyvinyl chloride) susceptible to radiation-induced cross-linking may be employed in forming the secondary closure. Alternatively, of course, cross-linking could be had by chemical means, as by diffusion cross-linking techniques. Polyethylene is the preferred secondary closure material.

If so desired, an adhesive (not shown) can be disposed between the interior surface of the collar 27 and the bead 24 to form a seal. Such an adhesive can include a germicidal agent to provide a sterile primary closure.

The embodiment illustrated in FIGS. 1 and 2, as described above, is the joint invention of Stephen H. Diaz and George W. Braymer, Jr., and is disclosed and claimed in copending application Ser. No. 871,398, filed on Jan. 23, 1978.

Figure 3:
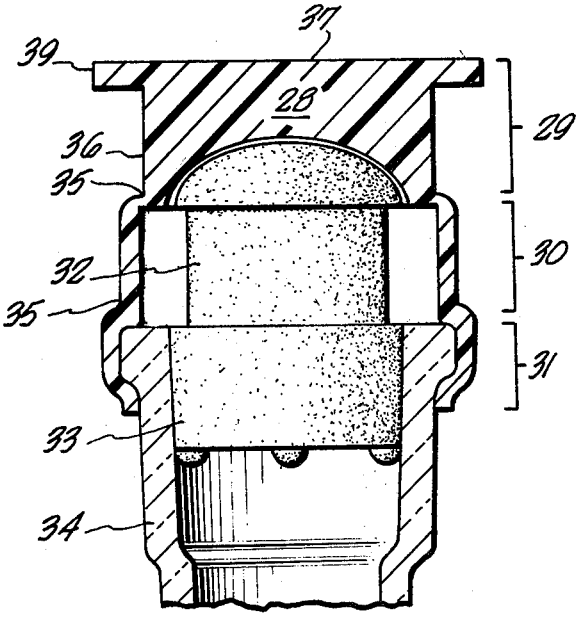
FIG. 3 is a partial, sectioned view of a secondary closure recovered about a closed vessel according to the invention.

In the invention as depicted in FIG. 3, a secondary closure 28 comprised of a plunger 29, mid-portion 30 and collar 31 is depicted as having been heat recovered about protuberant portion 32 of a resilient stopper whose nonprotuberant portion 33 is disposed in the neck 34 of a further vessel. An attenuated fracture zone 35 is disposed about the lowermost periphery of plunger 29. Mid-portion 30 is defined by an upstanding generally cylindrical wall 40 whose transverse interior dimension is greater than that of neck 34 and the exterior transverse dimension of that portion of plunger 29 defined by sidewalls 36. Accordingly, when downward thrust is imposed upon top wall 37 of plunger 29, occasioning fracture along attenuated fracture zone 35, plunger 29 will telescope within mid-portion 30, simultaneously engaging the uppermost portion of stopper 33 and driving the same down the neck 34 of the sealed vessel. In the embodiment of FIG. 3, mid-portion 30, neck 34 and plunger 29 are relatively dimensioned so that, in telescoping operation, the upper end of neck 34 ultimately acts as a stop to further downward travel to plunger 29.

Preferably, the plungers of the secondary enclosures employed in this invention are provided with an outwardly extending flange like those respectively depicted at 38 in FIGS. 2 and 3, the flanges being greater in transverse dimension than the interior transverse dimension of the mid-portions of the secondary closures so that, in telescoping operation, the uppermost portions of the "mid-portions" engage the plunger and may serve to stop further downward travel of the same.

The embodiment of FIG. 2 is particularly advantageous in that, in telescoping operation following fracture along the attentuation provided for that purpose, the lowermost portion of the plunger engages a generally circumferential shoulder 39 arising from the different exterior transverse dimensions of the protuberant and nonprotuberant portions of the stopper. In the prior art and, to an extent, in embodiments like that depicted in FIG. 3, excessive thrust pressure will cause bulging of the protuberant portion of the stopper, impeding its further entry into the neck of the sealed vessel. In the embodiment of FIG. 2, on the other hand, principal force is imposed upon a portion of the stopper already within the vessel neck, eliminating opportunity for bulging of the protuberant portion of the stopper.

Heretofore, in devices like those described in Bujan U.S. Pat. No. 2,908,274, before admixed medicaments could be withdrawn from the mixing vial following unseating of its divider plug, it was necessary to sterilize the uppermost portion of the stopper through which the hypodermic syringe or other withdrawal means was inserted. However, by the practice of this invention, only the interior surface of the plunger contacts the stopper during activation of the mixing vial. If, during assembly, the environs of the primary closure-secondary closure interface are maintained sterile, following activation of mixing action the fractured plunger may be removed and withdrawal means directly into a stopper untouched by any non-sterile surface during activation. In addition to this and the other advantages of the invention previously described, the secondary closure permits ready color-coding of sealed vessels, and provides a surface for embossed or otherwise-applied identifying information or other indicia.

While the invention has been described in connection with a specific embodiment thereof, it will be understood that it is capable of further modification, and this application is intended to cover any variations, uses or adaptations of the invention following, in general, the principles of the invention and including such departures from the present disclosure as come within known or customary practice in the art to which the invention pertains and as may be applied to the essential features hereinbefore set forth, and as fall within the scope of the invention and the limits of the appended claims.

I claim:

1. In combination, a two-compartment mixing vial having a constriction between the two compartments, a removable plug disposed within the constriction to provide a liquid-tight barrier between the two compartments, the vial being closed at one end and having a neck at the other end thereof for defining an opening communicating with one of said compartments, said neck defining an annular rim adjacent the free end thereof in surrounding relationship to said opening, a primary closure attached to said vial for closing the opening in said neck, said primary closure including a resilient stopper having a nonprotuberant portion snugly and slidably disposed within the neck for closing said opening, said stopper also having a protuberant portion which is fixedly attached to said nonprotuberant portion and projects outwardly beyond the free end of said neck, said protuberant portion having a transverse dimension which is smaller than the transverse dimension of said opening, comprising the improvement wherein a hollow frangible secondary closure is disposed about the protuberant portion of the stopper and is fixedly connected to the neck of said vial, said secondary closure including:

(1) a plunger having a top wall and upstanding sidewalls, which are displaced outwardly from said protuberant portion, said sidewalls having at least the lower edges thereof spaced upwardly from but substantially longitudinally aligned with the free end of said annular rim, whereby imposition of a longitudinally directed pushing force on said plunger causes it to axially slide toward said neck with the slidable displacement of said plunger being limited by engagement of the lower edges of said sidewalls with the free end of said annular rim;

(2) a lower collar in encircling engagement with the annular rim formed on the neck so as to fixedly connect said secondary closure to said vial while resisting non-destructive disengagement therebetween;

(3) a mid-portion integrally joining the lower edge of said plunger to said lower collar, said mid-portion extending longitudinally of said vial between said lower collar and said sidewalls in surrounding relationship to said protuberant portion, said mid-portion having a length in said longitudinal direction which is substantially greater than the radial thickness thereof, and said mid-portion having an interior transverse dimension which is greater than the exterior transverse dimension of that portion of the plunger defined by the sidewalls thereof so that said sidewalls can be telescopically received within said mid-portion as the plunger is slidably moved toward said annular rim; and (4) an attenuated fracture zone about the lowermost periphery of the plunger sidewalls at the location where said sidewalls are joined to said mid-portion, whereby imposition of a pushing force on the plunger causes fracture along said zone so that the plunger telescopes into the mid-portion as the plunger is slidably urged toward the vial, the latter movement causing the plunger to engage and drive the stopper toward the closed end of the vial.

2. The combination according to claim 1, wherein the mid-portion comprises an elongated cylindrical sleeve part which is coaxially aligned with the vial and is disposed directly adjacent and projects outwardly from the free end of the neck, said mid-portion extending axially between and being integrally interconnected to and between the plunger sidewalls and the lower collar.

3. The combination according to claim 2, wherein the top wall of said plunger is disposed closely adjacent a top wall on said protuberant portion, whereby slidable displacement of said plunger toward said vial causes the plunger top wall to engage the top wall of said protuberant portion so as to slidably thrust said stopper downwardly into said vial.

4. A combination according to claim 3, wherein the annular rim as defined at the free end of said vial comprises a radially outwardly extending annular flange, and wherein said lower collar encircles and projects under the lower side of said annular flange for fixedly securing said secondary closure to said vial.

5. A combination according to claim 1, wherein the top wall is integral with said sidewall and includes a flange portion which projects outwardly beyond said sidewalls and is of greater transverse dimension than said mid-portion.

* * * * *